US006320937B1

(12) United States Patent
Mochizuki

(10) Patent No.: US 6,320,937 B1
(45) Date of Patent: Nov. 20, 2001

(54) METHOD AND APPARATUS FOR CONTINUOUSLY GENERATING LASER PLASMA X-RAYS BY THE USE OF A CRYOGENIC TARGET

(76) Inventor: Takayasu Mochizuki, 6-40-3, Honmachi, Shibuya-ku, Tokyo (JP)

( * ) Notice: Subject to any disclaimer, the term of this patent is extended or adjusted under 35 U.S.C. 154(b) by 0 days.

(21) Appl. No.: 09/556,293

(22) Filed: Apr. 24, 2000

(51) Int. Cl.[7] ..... H01J 35/08
(52) U.S. Cl. ..... 378/143; 378/119
(58) Field of Search ..... 378/143, 119, 378/34, 120, 124; 372/5

(56) References Cited

U.S. PATENT DOCUMENTS

| | | | | |
|---|---|---|---|---|
| 4,058,486 | | 11/1977 | Mallozzi et al. | 250/493 |
| 4,184,078 | | 1/1980 | Nagel et al. | 250/492 A |
| 4,464,413 | * | 8/1984 | Murphy et al. | 427/6 |
| 4,700,371 | | 10/1987 | Forsyth et al. | 378/34 |
| 4,704,718 | * | 11/1987 | Suckewer | 372/5 |
| 4,723,262 | * | 2/1988 | Noda et al. | 378/119 |
| 4,735,762 | * | 4/1988 | Lasche | 376/102 |
| 4,860,328 | * | 8/1989 | Frankel et al. | 378/34 |
| 4,866,517 | | 9/1989 | Mochizuki et al. | 378/119 |
| 5,577,091 | * | 11/1996 | Richardson et al. | 378/119 |
| 5,577,092 | * | 11/1996 | Kublak et al. | 378/119 |
| 5,991,360 | * | 11/1999 | Matsui et al. | 378/119 |
| 6,038,279 | * | 3/2000 | Miyake et al. | 378/34 |

OTHER PUBLICATIONS

P.J. Mallozzi et al. "Laser–generated plasmas as a source of x rays for medical applications", J. of Applied Physics vol. 45, No. 4, pp. 1891–1895 (1974).

A.L. Hoffman et al., "High, brightness laser/plasma source for high throughput submicron x–ray lithography", J. Vac. Sci. Technol. B3(1) pp. 258–261 (1985).

N. Kandaka et al., "Effective reduction of debris emitted from a laser–produced plasma", Jpn. J. Appl. Phys. vol. 37 pp. L174–L176 (1998).

A. Shimoura et al., "X–ray generation in cryogenic targets irradiated by 1 $\mu$m pulse laser", appl. Phys. Lett. 72 (2), pp. 164–166, (1998).

T. Mochizuki, "Laser plasma x–ray source by cryogenic target and high–rep rate slab YAG laser", Proc. of SPIE vol. 3886, pp. 316–318, (2000).

* cited by examiner

*Primary Examiner*—Robert H. Kim
*Assistant Examiner*—Irakli Kiknadze
(74) *Attorney, Agent, or Firm*—Foley & Lardner

(57) ABSTRACT

In a method and an apparatus for continuously generating laser plasma X-rays, pulsed X-rays are continuously generated at a stable output level for a long period of time from plasma produced by converging and irradiating a repetitive-shot pulsed main laser beam having high peak power onto a target formed on a cryogenic target layer. The basic structure comprises a rotary element having a cylindrical surface excellent in heat conductivity and rotatable within a vacuum chamber. A cooling device supplies the rotary element with a cryogenic fluid to cool. A cryogenic material supply mechanism supplies a chemically inert cryogenic material having a gaseous phase at temperature. From the cryogenic material, a cryogenic target layer of a predetermined thickness is formed on the surface of the rotary element. A main pulsed laser irradiating device continuously generates the pulsed X-rays from the plasma generated by the main laser beam generator. A crater produced after the main laser beam is converged and irradiated is brought into contact with the cryogenic material in a gaseous phase during rotation of the rotary element to reproduce the cryogenic target layer. The auxiliary laser beam device generates a pulsed auxiliary laser beam under separate control and irradiates the beam to remove fine particle debris of the cryogenic target layer ejected from the converging irradiation spot after dissipation of the plasma so as to heat the fine particle debris to vaporize and eliminate the debris.

15 Claims, 9 Drawing Sheets

METHOD AND APPARATUS FOR CONTINUOUSLY GENERATING LASER PLASMA X-RAYS BY THE USE OF A CRYOGENIC TARGET

BACKGROUND OF THE INVENTION

The present invention relates to a continuous X-ray generation method and apparatus in which pulsed X-rays are continuously generated from plasma produced by converging and irradiating a repetitive-shot pulsed main laser beam having high peak power onto a target. In particular, the present invention relates to a continuous X-ray generation method and apparatus in which the above-mentioned target comprises a cryogenic target layer formed by the use of a rare gas or a chemically inert cryogenic (low-temperature) material having a gaseous phase at room temperature that is liquefied or solidified by cooling and in which the above-mentioned X-rays are continuously generated at a stable high output level over a long period of time when the pulsed main laser beam is converged and irradiated onto the cryogenic target layer.

It has been known from the 1970's that high-temperature high-density laser plasma is generated by converging pulsed laser light having high peak power onto a point having a diameter of 100 $\mu$m or less to irradiate a solid target therewith and that the laser plasma emits pulsed X-rays of high brightness as laser plasma X-rays.

As regards the use of the laser plasma X-rays, a medical application was disclosed or proposed in US patent specification "P. J. Mallozzi et al; U.S. Pat. No. 4,058,486 (Nov. 15, 1977)" and an article "Journal of Applied Physics Vol. 45, pp. 1891 (1974)", as early as in 1974. In 1978, D. J. Nagel and his group disclosed the possibility of application to a light source for X-ray lithography in US patent specification "D. J. Nagel et al.; U.S. Pat. No. 4,184,078 (Jan. 1980)". Afterwards, it was revealed that the spectral intensity of the X-rays has laser wavelength/intensity dependency, target element dependency, or the like.

As a target which generates the plasma in response to an incident laser beam converged thereon, a cylindrical rotary drum target and a strip target were disclosed in US patent specification "J. M. Forsyth et al; U.S. Pat. No. 4,700,371 (Oct. 13, 1987)". However, since each of these targets is made of a solid material mainly comprising a metal such as copper (Cu), aluminum (Al), or gold (Au), there arise problems that the material around the converging point is vaporized by laser heating and deposited on the inside surface of the surrounding chamber wall and on the surface of the expensive X-ray mirror for converging the laser plasma X-rays which are emitted, that fine particles are ejected to damage the surface of the X-ray mirror, and so on. In view of the above, the use is restricted to a laboratory light source operated for a short period of time. Specifically, since the solid material of the target that is deposited onto the surface of the X-ray mirror strongly absorbs the X-rays, the reflectivity of the mirror is reduced so that the effective intensity of the available X-rays is decreased with time. It is therefore necessary to periodically replace the expensive X-ray mirror.

In order to solve the above-mentioned problems, A. L. Hoffman et al proposed in "Vacuum Science and Technology B3(1), pp. 258,1985" the technique of providing a mechanical shutter 12 in the space extending to the surface of the X-ray mirror, as shown in FIG. 1 appended to the present specification. Furthermore, it was proposed by N. Kandaka et al in "Japanese J. Applied Physics 37, L174–L176, 1998"

to prevent the above-mentioned vaporized gas molecules from flowing to the X-ray mirror by means of a high-density buffer gas region 24 created by a gas cell 23, as shown in FIG. 2 appended to the present specification.

Also, since the rotary drum 11 (FIG. 1) or the strip 22 (FIG. 2) used as the target is repeatedly exposed to converging irradiation by the laser light, these targets are short in life due to vaporization and wear and must frequently be replaced.

In order to overcome the above-mentioned problems, a conventional continuous X-ray generation apparatus of the type described uses a cryogenic target layer made of a cryogenic material obtained by cooling and liquefying or solidifying a chemically inert material having a gaseous phase at room temperature, for example, a rare gas.

For example, U.S. Pat. No. 4,866,517 discloses an apparatus for continuously supplying a cryogenic target made of a cryogenic material obtained by cooling and liquefying or solidifying, as shown in FIG. 3.

Specifically, as shown in FIG. 3, a vacuum chamber 31 is provided with a belt conveyor 32 arranged therein and having a rotary endless belt 33 continuously movable. The cryogenic target material, liquefied or solidified, is supplied from a cryogenic material supply path 34 onto the surface of the rotary endless belt 33 and deposited thereon to form a cryogenic target layer 35.

On the other hand, a pulsed laser beam is incident into the vacuum chamber 31 through an incidence port 36 to form a converging irradiation spot 37 on the cryogenic target layer 35 deposited on the surface of the rotary endless belt 33 which is moving. At the converging irradiation spot 37, the cryogenic material of the cryogenic target layer 35 is converted into plasma to emit pulsed X-rays. The pulsed X-rays are led out through an X-ray emission port 38.

For the cryogenic target layer 35 converted into plasma and cratered at the converging irradiation spot 37, the cryogenic material is continuously supplied through the cryogenic material supply path 34 to the surface of the rotary endless belt 33 which is moving, thereby restoring the cryogenic target layer 35.

In the above-mentioned continuous X-ray generation apparatus in which the cryogenic target layer is transferred to the converging irradiation spot of the laser beam by the use of the rotary endless belt, the following problems arise.

The first problem is that the rotary endless belt, which is cooled only when it is brought into contact with a rotary element at cryogenic temperature, is subjected to bending and extending actions at cryogenic temperature and is therefore shortened in life. Furthermore, it is difficult to maintain stable low temperature at the surface to which the supplied cryogenic material is deposited.

The second problem is as follows. In the cryogenic target layer formed by the cryogenic material supplied through the supply path and deposited on the rotary endless belt, it is difficult to achieve uniform thickness along the surface. In this event, the relative position of the converging irradiation spot of the laser beam with respect to a direction normal to the surface of the cryogenic target layer may be deviated from a predetermined position, depending on the location on the surface, and therefore the intensity of the X rays generated may be unstable.

The third problem is as follows. The cryogenic material supplied from the cryogenic material supply path is directly deposited onto the rotary endless belt at poor efficiency. This means that the cryogenic material gas having a relatively high density is present in the vicinity of the converging irradiation spot of the laser beam. Accordingly, the X-rays once generated are reabsorbed by the cryogenic material gas itself to thereby effectively decrease the efficiency of X-ray generation.

On the other hand, in order to shorten the restoration time of the craters produced by the pulsed laser beam for plasma generation, the pressure or the density of the plasma generating target gas within the vacuum chamber must be increased. However, not only due to the above-mentioned third problem but also because the incident laser light itself is absorbed by the plasma generating gas within the vacuum chamber to cause gas discharge before reaching the converging irradiation spot of the laser beam, the laser plasma can not be generated at the converging irradiation spot of the laser beam.

The fourth problem is that, in case where the speed or the kinetic energy of fine particles produced by fragmentation of the target material is high, there still remains the risk of causing unrecoverable mechanical damage to the multi-layer film at the surface of the X-ray mirror due to bombardment of the fine particles.

This is because, after generation of the laser plasma by the pulsed laser light having high peak power, fine particles or debris produced by fragmentation of the target material are generally discharged from the target material following the vaporization of neutral gas molecules having a relatively high temperature. It has been reported that the multi-layer film on the surface of the X-ray mirror is damaged even by the fine particles from the cryogenic target layer, particularly when the fine particles have a diameter not smaller than 5 $\mu$m and a speed not lower than about 1 km per second.

It is therefore an object of the present invention to solve the above-mentioned problems and to provide a continuous X-ray generation apparatus which does not require the replacement of a target substrate coated with a cryogenic target layer for generating plasma in response to converging irradiation of a laser beam, which is capable of continuously generating pulsed X-rays having a stable high average output level even by irradiation of a repetitive-shot pulsed laser beam having high peak power, and which is capable of continuously generating laser plasma X-rays having a stable high average output level without causing X-ray optics including an X-ray reflecting mirror for converging the generated laser plasma X-rays to be damaged by high-speed fine particles ejected from a target material.

SUMMARY OF THE INVENTION

According to the present invention, a continuous X-ray generation method for continuously generating X-rays using a laser comprises the steps of preparing a cryogenic target formed by a chemically inert cryogenic material having a gaseous phase at room temperature, preparing an apparatus for generating a plurality of laser beams different in intensity from one another, and irradiating the laser beams towards the cryogenic target to continuously generate the X-rays and to remove undesired materials accompanying the generation of the X-rays.

According to a specific aspect, a method of continuously generating pulsed X-rays from plasma generated by converging and irradiating a repetitive-shot pulsed main laser beam having high peak power onto a target is characterized by preparing a chemically inert cryogenic material having a gaseous phase at room temperature, a rotary element which has a surface excellent in heat conductivity, which is rotatable in a vacuum chamber, and which serves as a target substrate for the main laser beam, and an auxiliary pulsed laser beam separate from the main laser beam, and by including the following steps.

Specifically, the method comprises the steps of supplying a cryogenic fluid to the rotary element to cool at least a part of the surface of the rotary element to a temperature not higher than the liquefaction point of the cryogenic material, supplying the cryogenic material in a gaseous phase to the surface of the rotary element being cooled to form a cryogenic target layer of a predetermined thickness from the cryogenic material converted into at least one of a liquid phase and a solid phase, continuously generating pulsed X-rays from plasma produced by converging and irradiating the repetitive-shot pulsed main laser beam having high peak power onto the cryogenic target layer as the target, and irradiating the auxiliary laser beam to fine particle debris of the cryogenic target layer which are ejected from the converging irradiation spot after dissipation of the plasma, thereby heating the fine particle debris to vaporize and eliminate the fine particle debris.

Thus, the cryogenic target layer can be reproduced by rotating the rotary element so that the pulsed laser beam can be continuously supplied to the converging irradiation spot. Consequently, when the rotary element excellent in heat conductivity is cooled to cryogenic temperature and the cryogenic target layer is formed on the surface thereof, the thickness of the cryogenic target layer can be appropriately selected by selecting the speed of rotation of the rotary element, the temperature of the surface of the rotary element, the feeding rate of the cryogenic material supplied to the surface of the rotary element, and so on. Since the position of the converging irradiation spot of the pulsed laser beam can be successively displaced by rotation of the rotary element, the rotary element can be prevented from being damaged by the plasma at the converging irradiation spot of the pulsed laser beam.

According a specific embodiment of the present invention, a continuous X-ray generation apparatus is for continuously generating pulsed X-rays from plasma generated by converging and irradiating a repetitive-shot pulsed main laser beam having high peak power onto a target which is made of a chemically inert cryogenic material having a gaseous phase at room temperature, and comprises main laser beam generating means, a rotary element, a rotation drive mechanism, cooling means, a cryogenic material supply mechanism, main pulsed laser irradiating means, and auxiliary laser beam supplying means. The main laser beam generating means generates the pulsed main laser beam. The rotary element has a surface excellent in heat conductivity, is rotatable within a vacuum chamber, and is used as a target substrate for the main laser beam. The rotation drive mechanism drives a rotation shaft of the rotary element to rotate the rotary element. The cooling means supplies a cryogenic fluid to the rotary element to cool at least a part of the surface of the rotary element to a temperature not higher than the liquefaction point of the cryogenic material. The cryogenic material supply mechanism supplies the cryogenic material to the cooled surface of the rotary element to cool the cryogenic material so that a cryogenic target layer having a predetermined thickness is formed from the cryogenic material in at least one of a liquid phase and a solid phase. The main pulse laser irradiating means converges and irradiates the generated main laser beam onto a predetermined converging irradiation spot of the cryogenic target layer to generate the plasma. The auxiliary laser beam supplying means generates a pulsed auxiliary laser beam to heat and vaporize or gasify fine particle debris of the cryogenic material that is discharged from the surface of the converging irradiation spot of the cryogenic target layer.

By the above-mentioned means, there is provided a continuous X-ray generation apparatus which does not require the replacement of a target substrate coated with a cryogenic target layer for generating plasma in response to converging irradiation of a laser beam, which is capable of continuously generating pulsed X-rays having a stable high average output level even by converging irradiation of a repetitive-shot pulsed laser beam having high peak power, and which is capable of continuously generating laser plasma X-rays having a stable high average output level without causing an X-ray optical element including an X-ray reflecting mirror for converging the generated laser plasma X-rays to be damaged by high-speed fine particles ejected from the cryogenic target layer.

The continuous X-ray generation apparatus may further comprise, as a structure for forming the cryogenic material deposited on the surface of the rotary element being rotated into the cryogenic target layer having a substantially uniform thickness, a fixed wall surrounding the rotary element with a predetermined gap adapted to receive and trap the cryogenic material in a gaseous phase supplied from the cryogenic material supply mechanism, and a heat insulating structure cooperating with the cooling means to control and maintain the temperature of the fixed wall at an intermediate level between the liquefaction point of the cryogenic material and room temperature.

The fixed wall may comprise a partition wall which is formed in the vicinity of the converging irradiation spot in an aperture for incidence of the main laser beam and emission of the X-rays and which extends to the surface of the cryogenic target layer to define the thickness thereof. The cooling means has, as a cooling tank, an internal space defined by the surface of the rotary element of a cylindrical shape. The cooling tank may be provided with an inlet pipe and a discharge pipe coaxial with the rotary shaft. The inlet pipe serves to introduce, as cryogenic fluid, low-temperature liquefied gas which is to be reserved in the cooling tank for cooling the rotary element. The discharge pipe serves to discharge the low-temperature liquefied gas after gasified in the cooling tank.

The surface of the rotary element on which the cryogenic target layer is formed may be a side surface or a bottom surface assuming that the rotary element is of a cylindrical shape. Furthermore, a disc shaped target member excellent in heat conductivity may be provided in tight contact with the bottom surface of the rotary element serving as the cooling tank and the cryogenic target layer may be formed on the surface of this disc shaped target member.

The tip of the inlet pipe within the cooling tank may have a nozzle shape for generating a cryogenic gas stream by adiabatic expansion of the discharged low-temperature liquefied gas. The cryogenic material supply mechanism may supply at least one kind of cryogenic materials in a gaseous phase onto the surface of the rotary element and comprise a cryogenic material gas supply pipe, a variable flow rate valve for controlling the gas flow rate, and a reservoir tank for reserving the recovered cryogenic material. At least the variable flow rate valve and the reservoir tank may be provided for each type of the cryogenic material.

The auxiliary laser beam supplying means may comprise auxiliary laser beam generating means for generating the auxiliary laser beam, an auxiliary laser beam optical mechanism for guiding the generated auxiliary laser beam to an optical path bypassing the cryogenic target layer in the vicinity of the converging irradiation spot and converging the auxiliary laser beam to heat and vaporize or gasify fine particle debris of the cryogenic material being ejected, and auxiliary laser control means responsive to main laser beam generation information from the main laser beam generating means for controlling the auxiliary laser beam generating means to adjust the delay of the auxiliary laser beam guided to the optical path with respect to the main laser beam, the pulse duration, and the pulse energy.

DESCRIPTION OF THE PREFERRED EMBODIMENTS

Now, a continuous X-ray generation apparatus according to the present invention will be described in detail.

Figure 1:
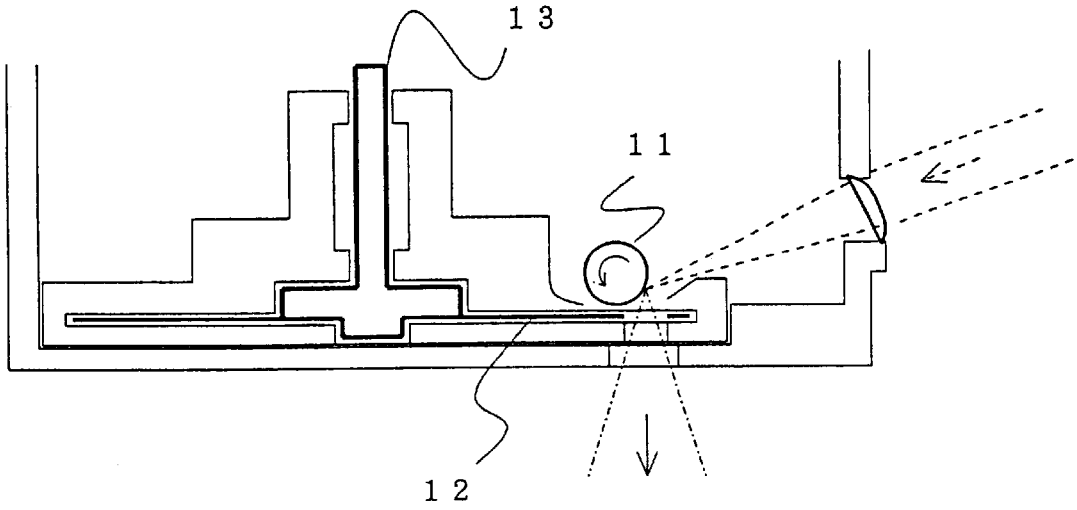
FIG. 1 is a sectional view for describing a conventional continuous X-ray generation apparatus.
Figure 2:
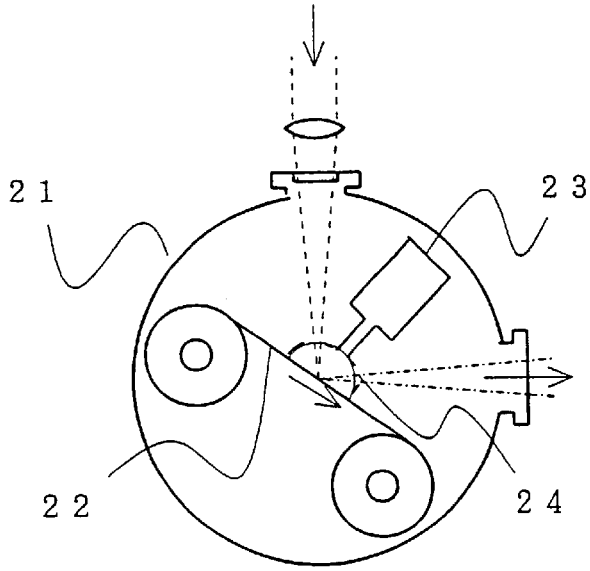
FIG. 2 is a sectional view for describing another conventional continuous X-ray generation apparatus different from that illustrated in FIG. 1.
Figure 3:
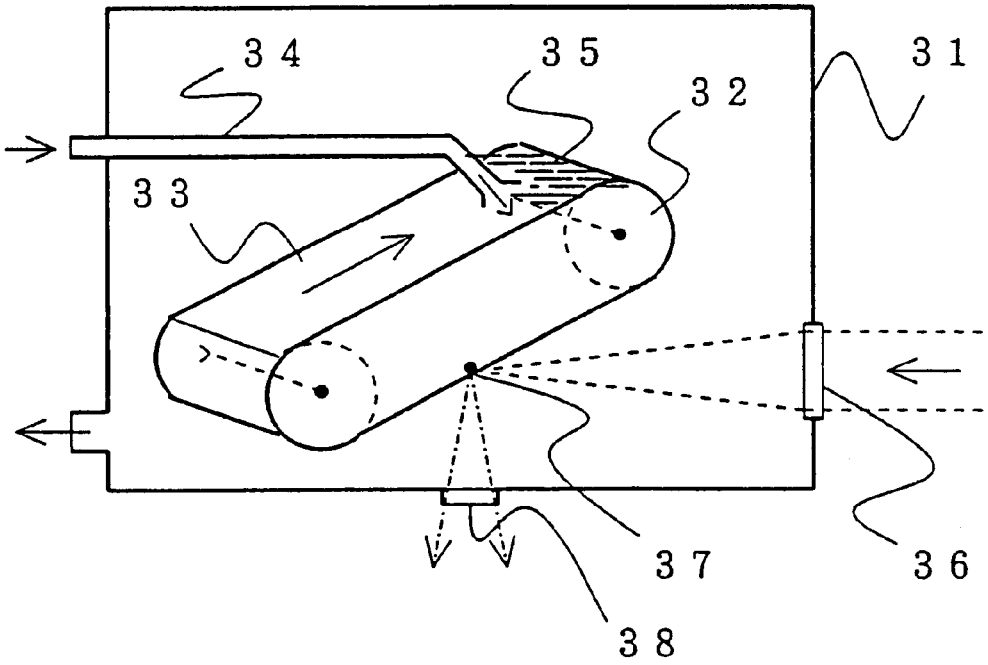
FIG. 3 is a sectional view for describing another conventional continuous X-ray generation apparatus different from those illustrated in FIGS. 1 and 2.
Figure 4:
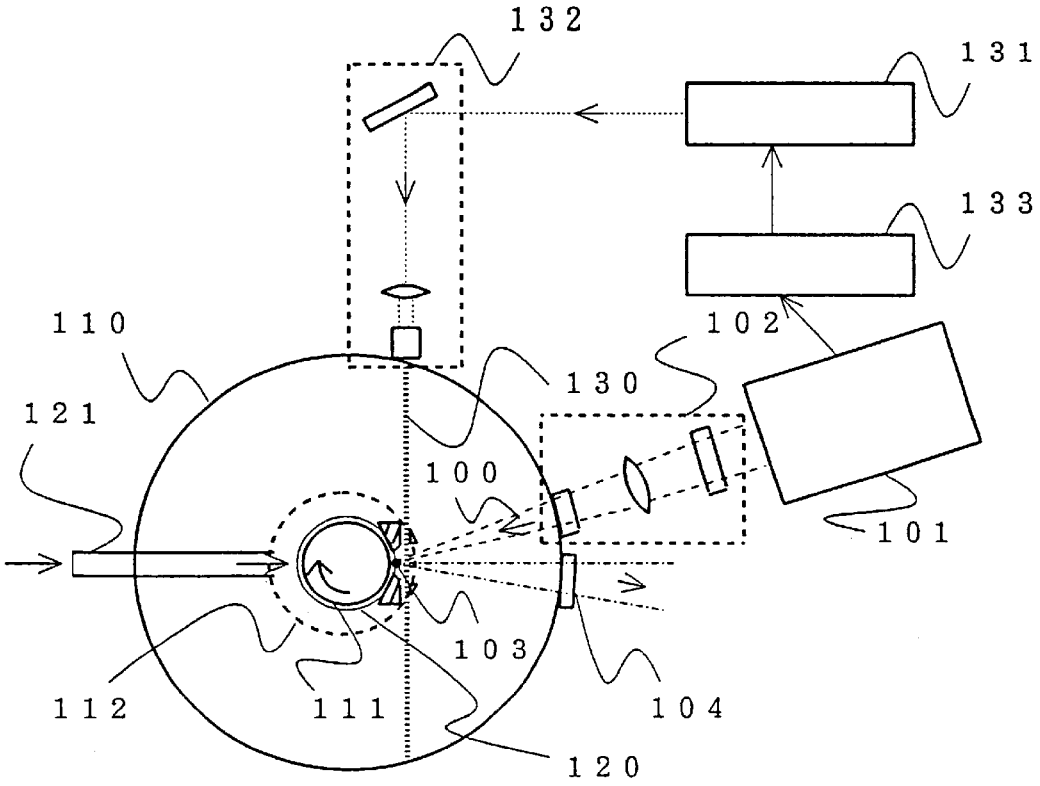
FIG. 4 is a view for describing one embodiment of the blocks and the arrangement of a continuous X-ray generation apparatus according to the present invention.

FIG. 4 is a view for describing one embodiment of the blocks and the arrangement of a continuous X-ray generation apparatus according to the present invention.

The continuous X-ray generation apparatus illustrated in FIG. 4 comprises, as main components, a main laser 101 for generating a pulsed laser beam for plasma generation, a cylindrical rotary element 111 to be cooled in a vacuum chamber 110 to serve as a target substrate, a supply path 121 for supplying a cryogenic material in a gaseous phase to form a cryogenic target layer 120 for generating X-rays on the cylindrical rotary element 111, and an auxiliary laser 131 for generating a pulsed auxiliary laser beam for vaporizing fine particles ejected from the cryogenic target layer 120.

The main laser 101 comprises, as an optical system 102, a reflecting mirror for guiding the main laser beam 100 and a condensing lens for converging irradiation through an incident glass window to a converging irradiation spot 103 on the surface of the cryogenic target layer 120. The auxiliary laser 131 comprises, as an optical system 132, a reflecting mirror for guiding the auxiliary laser beam 130 and a condensing lens for converging the beam in the vicinity of an area where the fine particles are ejected through the incident glass window. Although not shown in the figure, a swinging unit may be provided as a mechanism for swinging the orientation of the reflecting mirror in order to spatially sweep a converging irradiation region of the auxiliary laser beam 130.

The apparatus further comprises a control unit 133 for controlling the auxiliary laser 131 to emit the auxiliary laser beam 130 with a controlled delay with respect to a synchronization signal received from the main laser 101, and an X-ray emission port 104. A fixed wall 112 may be provided to confine the cryogenic material supplied through the supply path 121 around the rotary element 111.

Next referring to FIG. 5 in addition to FIG. 4, the condition around the converging irradiation spot 103 upon emission of the main laser beam 100 will be described.

The area surrounding the converging irradiation spot 103 is heated by the plasma generated around the converging irradiation spot 103 of the main laser beam 100. The heating causes gasification of neutral atoms and molecules from the cryogenic target layer 120 around the converging irradiation spot 103. After the gasification, micro-debris, i.e., fine particles of the cryogenic target layer 120 are emitted after a delay on the order of 1 $\mu$s. The speed of these fine particles is 1 km/s or less. The diameter of the high-speed fine particles is 10 $\mu$m or less.

The flight time required for the high-speed fine particles to reach a space separated by about 1 mm from the target surface is about 1 $\mu$s. Therefore, by making the auxiliary laser beam 130 be incident along the target surface only for a duration of 2 $\mu$s to 6 $\mu$s after the delay of about 2 $\mu$s from the pulse of the main laser beam 100, the high-speed fine particles can be irradiated synchronously.

Figure 5:
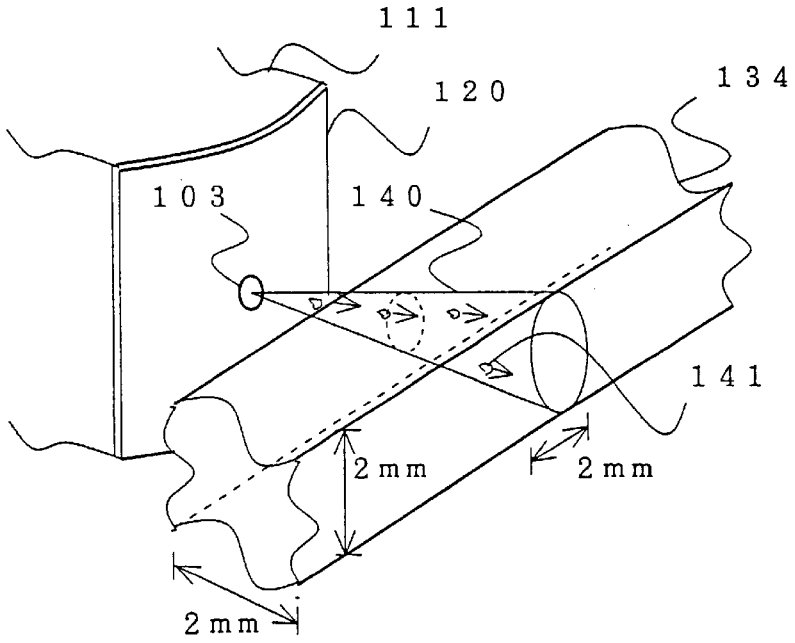
FIG. 5 is a perspective view illustrating one embodiment in the vicinity of a converging irradiation spot in FIG. 4.

In FIG. 5, the distribution of emission angles of the high-speed fine particles 141 emitted from the converging irradiation spot 103 is concentrated inside a conical region 140 within about 30 degrees with respect to the normal to the plane of the cryogenic target layer 120 at the converging irradiation spot 103. Accordingly, as shown in the figure, the auxiliary laser beam 130 irradiates the inside of a prism-shaped irradiation region 134 having a square cross section. Specifically, in the space above the converging irradiation spot 103, the auxiliary laser beam 130 irradiates with the above-mentioned delay the inside of the prism-shaped irradiation region 134 having a square cross section having a width of 2 mm in a direction perpendicular to a plane separated by 1 mm from the surface of the cryogenic target layer 120 and boundaries of 1 mm from the perpendicular line to the converging irradiation spot 130 in the direction orthogonal thereto. The time required for the ejected high-speed fine particles 141 to traverse the irradiation region 134 is 2 $\mu$s.

The dimensions specified above are mere examples. It is only necessary that the auxiliary laser beam 130 encloses the conical region 140 in the transversal direction. Although the cross-sectional shape of the auxiliary laser beam 130 is illustrated as a square shape, the shape is not restricted thereto at all.

For example, in case where the laser parameters include the pulse energy of 100 mJ, the pulse width of 2 $\mu$s, and the wavelength between 1 $\mu$m to 10 $\mu$m, the laser intensity converged within the above-mentioned irradiation region of 2 mm×2 mm is equal to $1.3\times10^6$ W/cm$^2$. The mass vaporization rate of the cryogenic target material irradiated with the above-mentioned laser intensity is about $5\times10^3$ g/cm$^2$/s. Therefore, within the laser pulse duration of 2 $\mu$s, the depth of direct vaporization during irradiation of the laser beam reaches about 30 $\mu$m in case where the cryogenic target material (xenon Xe) has a mass density of about 3 g/cm$^3$. Thus, high-speed fine particles having a diameter of 10 $\mu$m or less are fully vaporized and gasified.

The wavelength of the laser light used for the above-mentioned purpose is not restricted to the numerical values mentioned above. Since, if for example UV (ultraviolet) laser light of short wavelength is employed, the energy of the laser light is even more strongly absorbed, stronger vaporization and gasification can be achieved.

The auxiliary laser beam for vaporization is emitted at the timing after the delay adjusted by the control unit in response to a synchronization signal transmitted from the main laser.

Figure 6:
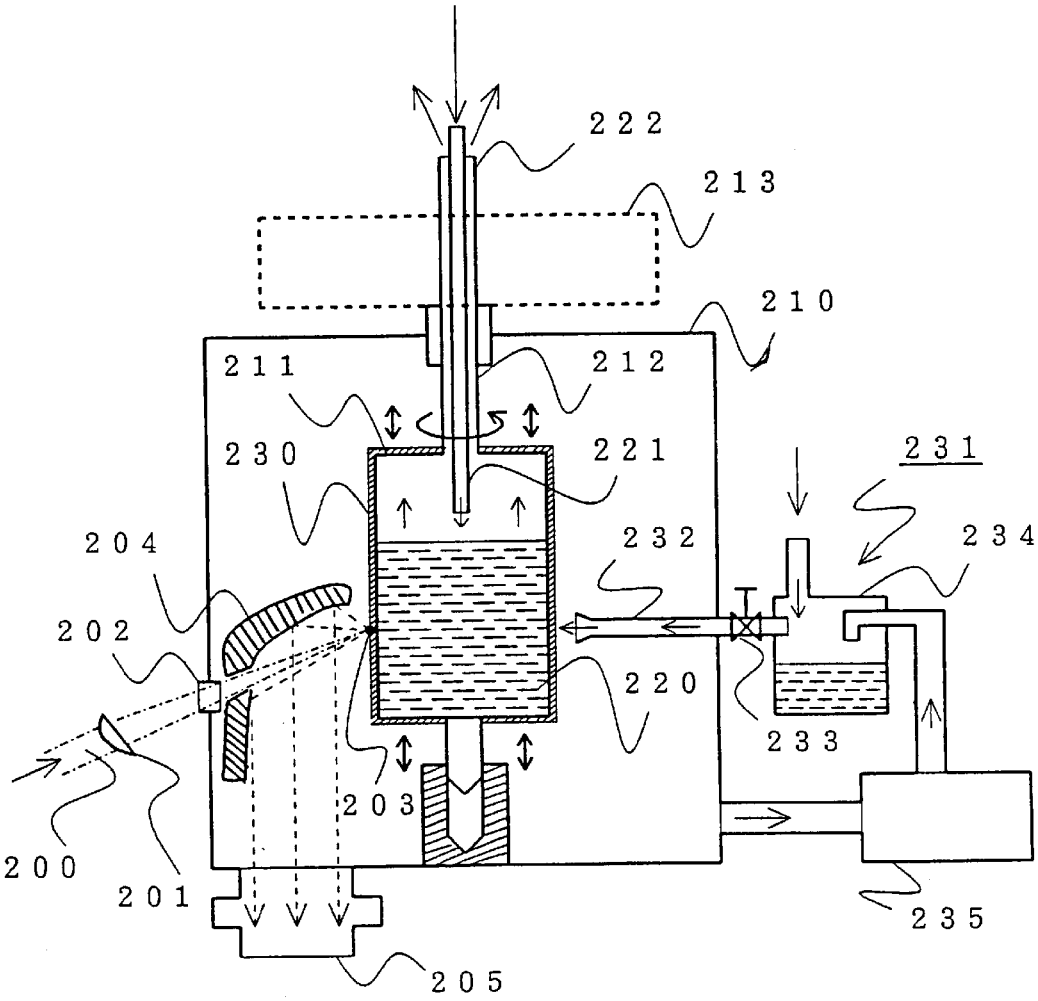
FIG. 6 is a sectional view for describing one embodiment of a portion for continuously generating X-rays in FIG. 4.

FIG. 6 is a sectional view for describing one embodiment of a portion for continuously generating X-rays n FIG. 4.

The continuous X-ray generating portion of the continuous X-ray generation apparatus illustrated in FIG. 6 comprises means for generating laser plasma X-rays in response to a main laser beam 200, a vacuum chamber 210, a cylindrical rotary element 211, a rotary shaft 212 of the rotary element 211, a rotation drive mechanism 213 for driving the rotation and the displacement of the rotary element 211, cooling means for cooling the rotary element 211, and a target supply mechanism 231 for supplying a cryogenic material to form a cryogenic target layer 230 to the rotary element 211.

As the means for generating laser plasma X-rays, illustrated are a converging mechanism 201 for the pulsed main laser beam 200, a laser incidence port 202, a converging irradiation spot 203, an X-ray mirror 204 for reflecting pulsed X-rays generated at the converging irradiation spot 203, and an X-ray emission port 205. As the cooling means of the rotary element 211, an inlet pipe 221 and a discharge pipe 222 for a cryogenic fluid 220 are illustrated. As a target supply mechanism 231, a supply path 232, a valve 233, a recovery tank 234, and an evacuation/recycle unit 235 are illustrated.

Within the vacuum chamber 210, the rotary element 211, which is excellent in thermal conductivity and which has a cylindrical surface and is hollow to serve as a cooling tank, has the rotary shaft 212 perpendicular to the horizontal plane. The rotary shaft 212 is supported by a rotary bearing arranged in the vacuum chamber 210. Preferably, the rotary shaft 212 is made of a material having a small thermal conductance and the rotary bearing is a magnetic bearing, although not restricted thereto.

The rotary shaft 212 is driven by the rotation drive mechanism 213 arranged outside of the vacuum chamber 210 at an end portion of the rotary bearing and comprising a mechanism for rotating the rotary element 211, for example, a motor and a drive gear. Preferably, the rotation drive mechanism 213 further includes a mechanism for driving the reciprocal movement of the rotary element 211 in the direction coincident with the rotation shaft, for example, a motor and a drive gear. As a result, the converging irradiation spot 203 of the main laser beam 200 can be displaced over a wide range on the surface of the rotary element 211.

The rotary shaft 212 is provided at the position of the central axis with the inlet pipe 221 for introducing, as the cryogenic fluid 220, low-temperature liquefied gas such as liquid nitrogen, liquid argon, or liquid helium from outside into the hollow interior of the rotary element 211. Around the inlet pipe 221, the discharge pipe 222 is coaxially arranged to discharge and recycle the gas as a result of gasification of the cryogenic fluid 220. Accordingly, the cryogenic fluid 220 is introduced through the inlet pipe 221 and stored as a liquid in the hollow interior of the rotary element 211 to cool the cylindrical surface of the rotary element 211 to a temperature not higher than the liquefaction temperature of the cryogenic material as the cryogenic target layer 230 utilizing the heat conduction of the rotary element 211.

On the other hand, the cryogenic material is a material of the target to be subjected to converging irradiation of the main laser beam 200 for generating the laser plasma. The cryogenic material in a liquid phase is supplied from outside to the recovery tank 234 to be stored therein, and is supplied through the supply path 232 to the surface of the cooled rotary element 211 to form the cryogenic target layer 230 in a liquid or a solid phase. Environmental conditions, such as the rotation speed of the rotary element 211, the temperature of the cylindrical surface, and the feeding rate of the cryogenic material supplied to the cylindrical surface are set so that the cryogenic target layer 230 is formed to the thickness between 10 $\mu$m and about 500 $\mu$m.

The cryogenic material turned into a gaseous phase when the cryogenic target layer 230 is converted into plasma is extracted by the evacuation/recycle unit 235 to the outside of the vacuum chamber 210, sent to the cryogenic material recovery tank 234 where it is cooled to be re-converted into a liquid phase or a solid phase and stored therein, and gasified again to be successively supplied through the supply path 232 to the surface of the rotary element 211 within the vacuum chamber 210. The evacuation/recycle unit 235 is operated so as to maintain the interior of the vacuum chamber 210 at a pressure not higher than $133\times10^{-3}$Pa.

Although the evacuation/recycle unit 235 and the recovery tank 234 are illustrated herein as separate units, these components may be integrated into a single unit by the use of a cryogenic vacuum pump or the like without being restricted thereto.

On the other hand, the main laser beam 200 is converged via the laser converging mechanism 201 and irradiated from the laser incidence port 202 of the vacuum chamber 210 to reach the converging irradiation spot 203 of the cryogenic target layer 230. Then, the pulsed X-rays generated from the plasma produced at the converging irradiation spot 203 are converged by the X-ray mirror 204 and emitted from the X-ray emission port 205.

As described above, the cryogenic target layer 230 can be continuously supplied to the converging irradiation spot 203 of the main laser beam 200 by rotating the rotary element 211. Furthermore, by the reciprocal movement of the rotary shaft 212 together with the rotary element 211 in the direction coincident with the rotary shaft, the cryogenic target layer 230 freshly formed on the cylindrical surface of the rotary element 211 in the range of the reciprocal movement in the axial direction can be continuously supplied to the converging irradiation spot 203.

Thus, when the rotary element 211 excellent in thermal conductivity is cooled to cryogenic temperature to form the cryogenic target layer 230 on the cylindrical surface, the cryogenic target layer 230 can be formed to an appropriate thickness by selecting the rotation speed of the rotary element 211, the temperature of the cylindrical surface, and the feeding rate of the cryogenic material supplied to the cylindrical surface, and so on. Since the position of the converging irradiation spot 203 of the main laser beam 200 can be successively displaced by the rotation of the rotary element 211 and the reciprocal movement in the axial direction, the rotary element 211 can be prevented from being damaged by the plasma produced at the converging irradiation spot 203.

Next referring to FIGS. 7 and 8 in addition to FIG. 6, description will be made of one embodiment in which the cryogenic target layer 230 can be stably formed to have a uniform thickness.

Figure 7:
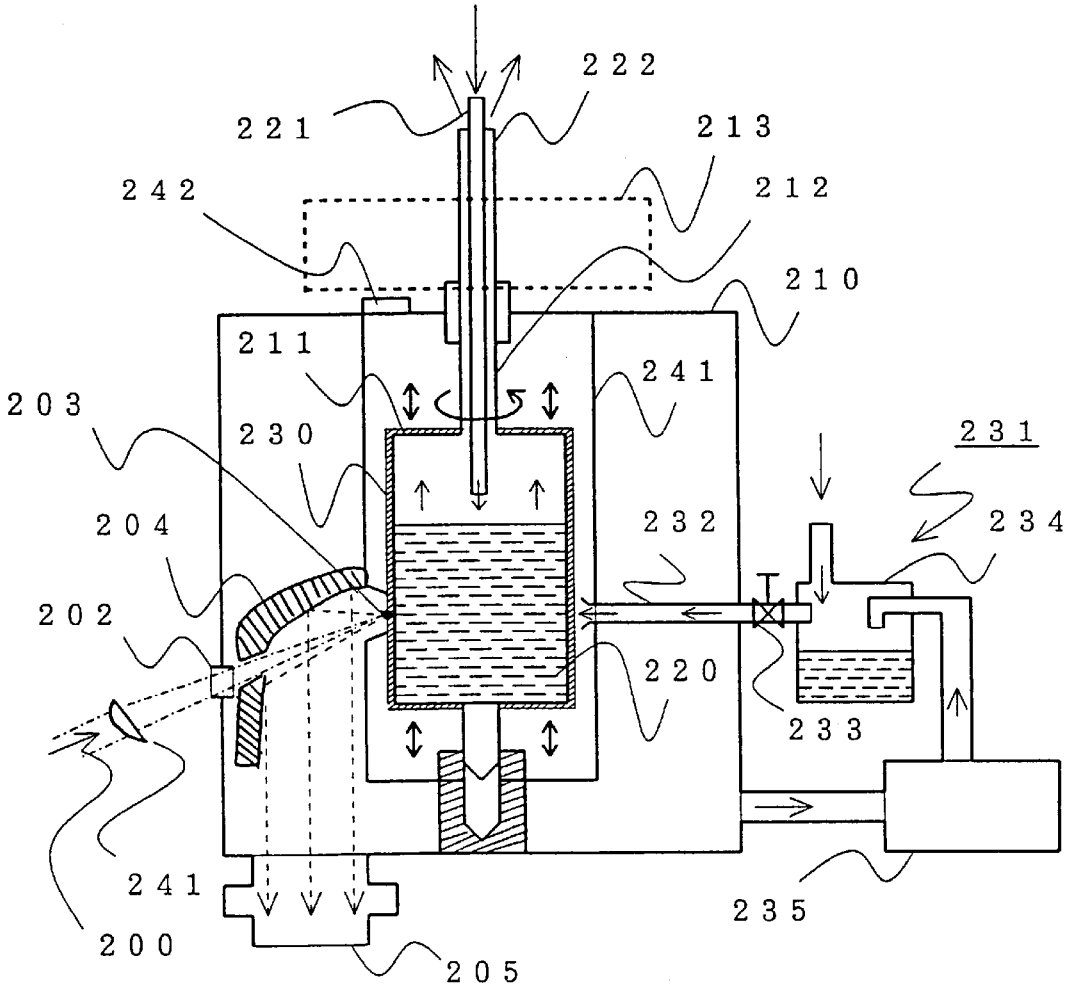
FIG. 7 is a sectional view for describing one embodiment in which a fixed wall is added to the embodiment of FIG. 6.

FIG. 7 is different from FIG. 6 in that a fixed wall 241 is provided.

The fixed wall 241 surrounds a cylindrical rotary element 211 with a gap therebetween so that the cryogenic material is injected into this gap to be trapped therein, and has a cylindrical shape same as that of the rotary element. In order to form the cryogenic target layer 230 having a thickness between 10 $\mu$m and 500 $\mu$m in a liquid or a solid phase on the surface of the rotary element 211 cooled so that the surface temperature is not higher than the gas liquefaction point, the fixed wall 241 must be maintained at a temperature substantially equal to or higher than the liquefaction point of the cryogenic material. In this connection, the fixed wall 241 has a structure coupled to the vacuum chamber 210 in contact with the atmospheric air at room temperature. If necessary, a heat insulator 242 may be provided as a heat insulating structure for maintaining such a temperature. The fixed wall has a cylindrical shape in the foregoing description but is not restricted to the cylindrical shape.

After the cylindrical surface of the rotary element 211 is cooled to a temperature such that the cryogenic material is sufficiently liquefied or solidified, the cryogenic material gas is introduced and supplied by the supply path 232 to the space between the fixed wall 241 and the surface of the rotary element 211 through a supply port formed in the fixed wall 241 to form the cryogenic target layer 230 on the surface of the cooled rotary element 211 to a thickness between 10 $\mu$m and about 500 $\mu$m. In this process, the pressure of the cryogenic material gas inside the fixed wall 241 is maintained, for example, in a range between $133\times10^{-3}$ Pa and $133\times10^{+2}$ Pa and the deposition rate is selected by controlling a valve 233 arranged in the middle of the cryogenic material supply path 232 and the surface temperature of the rotary element 211. The cryogenic material supplied to the surface of the rotary element 211 has a gaseous phase in the foregoing description but may be in a liquid phase.

Referring to FIG. 7, a plurality of target supply mechanisms can be provided so that cryogenic materials controlled in mixing ratio of different kinds of elements by means of the temperature and the valve are supplied from the respective target supply mechanisms to form the cryogenic target layer. Specifically, the cryogenic target layer can be formed by mixing the material, such as water ($H_2O$) and carbon dioxide gas ($CO_2$), made of light elements having atomic numbers less than 10 with the cryogenic material comprising heavy elements having atomic number of 10 or more, such as rare gas emitting the X-rays, for example, argon (Ar), krypton (Kr), and Xenon (Xe). It will readily be understood that the elements used as the cryogenic target layer are not restricted to the elements exemplified above.

With the above-mentioned structure, the content of the heavy elements which mainly absorb X-rays can be reduced even if the cryogenic material forming the cryogenic target layer is gasified. On the other hand, absorption of X-rays by the light elements is relatively low. It is therefore possible to prevent the X-rays from being attenuated by the cryogenic gas gasified by plasma generation and remaining in the X-ray emission path due to insufficient evacuation.

In this case, even if the light elements are admixed, the amount of X-rays emitted from the light elements used in the cryogenic target layer is extremely small and the corresponding energy is effectively used to heat the plasma. Consequently, the temperature of the plasma becomes high as compared with the case where the heavy elements alone are used. As a result, the amount of X-rays emitted from the heavy elements is not decreased. At an appropriate mixing ratio, the amount of the X-rays is same or rather increased as compared with the case where the heavy elements alone are used.

The molar mixing ratio of the material component comprising the heavy elements is preferably between a few percent and 50 percent of the material component comprising the light elements. The cryogenic target layer is formed at the molar mixing ratio adjusted with reference to the selected environmental conditions including the feeding rates of the respective material components and the ambient temperature.

Figure 8:
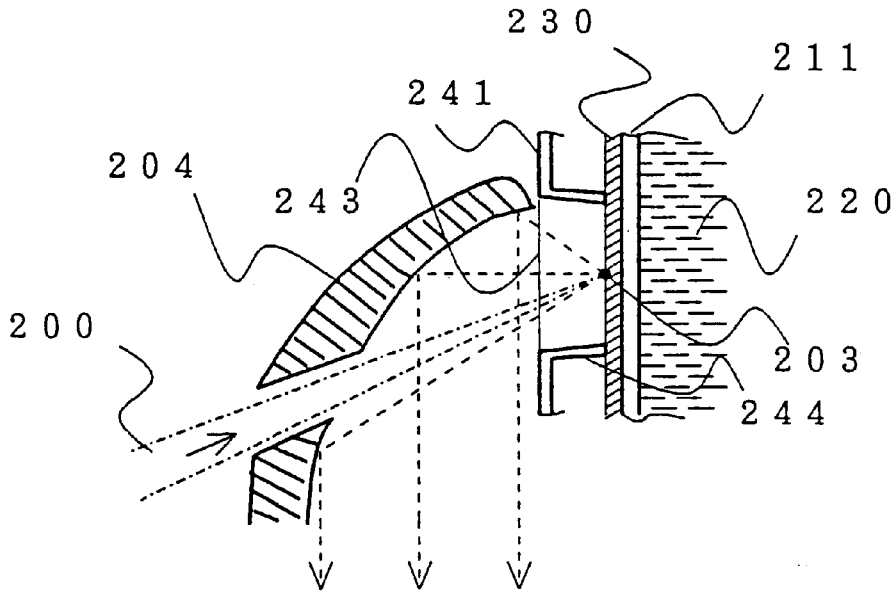
FIG. 8 is a partial sectioned view of the embodiment of FIG. 7.

As illustrated in detail in FIG. 8, in the vicinity of the converging irradiation spot 203 of the main laser beam 200, the fixed wall 241 is provided with an aperture 243 centered on the converging irradiation spot 203 and having a radius between 0.5 cm and 5 cm so that the main laser beam 200 reaches the converging irradiation spot 203 without being interfered by the fixed wall 241 and so that the pulsed X-rays being generated are emitted to the outside without being intercepted by the fixed wall 241. Furthermore, a partition wall 244 having an edge brought into contact with the surface of the cryogenic target layer 230 is provided so that the cryogenic material gas trapped between the surface of rotary element 211 and the fixed wall 241 does not flow out from the aperture 243.

The light source of the main laser beam 200 to be incident to the cryogenic target layer 230 is a pulsed laser light source of high peak power and high repetition rate. In one embodiment, a pulsed laser beam having a laser wavelength of 1 $\mu$m, pulse energy of 0.7 J to 1.0 J, pulse width of 15 ns, and a repetition frequency of 300 Hz to 3000 Hz is emitted. The main laser beam 200 is converged and irradiated onto the surface of the cryogenic target layer 230 at a spot diameter of about 100 $\mu$m as the converging irradiation spot 203. In this case, the laser intensity on the surface of the cryogenic target layer 230 is about $10^{12}$ W/cm$^2$.

It has experimentally been found that, at this light intensity, X-rays are radiated from the cryogenic material converted into plasma and the conversion efficiency from the incident laser energy into the radiated X-ray energy is about 1%/nm/sr in case of a xenon cryogenic target that strongly radiates X-rays having a wavelength of 11 nm, as shown in the report "Applied Physics Letters Vol. 72, pp. 164 (1998)" by A. Shimoura, S. Amano, S. Miyamoto and T. Mochizuki. Therefore, if the radiated X-rays are extracted as a beam by the X-ray mirror 204 with the wavelength width of 1 nm and a solid angle of 3 sr, an output of 9 W to 90 W is obtained as the average X-ray output.

In order to obtain stable pulsed X-rays by operating the pulsed laser beam with a repetition frequency of 300 Hz to 3000 Hz, a fresh surface of the cryogenic target layer 230 must be irradiated at every single shot.

It is assumed that the distance from a converging irradiation spot to a next converging irradiation spot on the plane of the cryogenic target layer 230 is 500 $\mu$m. In this event, the rotary element 211 having a radius R (cm) is required to have a rotation speed of "150/R" to "1500/R" rpm. If the radius R is equal to 7.5 cm, the rotation speed must be 20 to 200 rpm.

After the cryogenic material of the cryogenic target layer 230 is gasified around the converging irradiation spot 203 by converging irradiation of the main laser beam 200, a crater-like mark is produced in the cryogenic target layer 230. If the main laser beam 200 is again or repeatedly converged and irradiated onto this mark, the plasma generation may become unstable. In the worst case, the crater hole penetrates to the bottom of the cryogenic target layer 230 so that the cylindrical surface of the rotary element 211 is directly heated and vaporized.

Taking the above into consideration, as shown in FIG. 7, the rotary element 211 is not only rotated by the rotary shaft 212 but also performs reciprocal movement along the rotation shaft to prevent the main laser beam 200 from repeatedly irradiating the same place on the surface of the cryogenic target layer 230 in a short period of time. The crater-like mark is repaired because the cryogenic material gas present in the gap inside the fixed wall 241 is immediately deposited during rotation.

Next referring to FIG. 9 in combination with FIG. 6, description will be made of another cooling means different from that described above.

Figure 9:
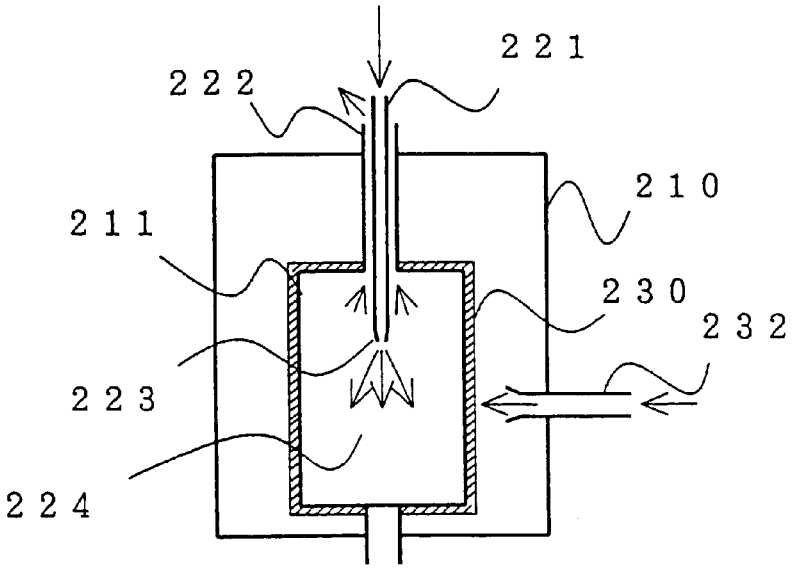
FIG. 9 is a sectional view for describing one embodiment of cooling means according to the present invention but different from FIG. 6 or FIG. 7.

FIG. 9 is different FIG. 6 in that, in the cooling tank which is the internal space of the rotary element 211, the cryogenic fluid is jet-injected by a nozzle 223 provided at the tip of the inlet pipe 221 to cause adiabatic expansion. The cryogenic fluid used herein may be a low-temperature liquefied gas such as liquid nitrogen, liquid argon, or liquid helium, or a low-temperature high-pressure gas of any one of these elements. Upon adiabatic expansion of the cryogenic fluid injected from the nozzle 223, a cryogenic gas stream 224 is generated to cool the internal wall of the rotary element 211 so that the cylindrical surface of the rotary element 211 is cooled utilizing heat conduction.

Next referring to FIG. 10, description will be made of one embodiment of the continuous X-ray generation apparatus according to the present invention but different from that of FIG. 4.

Figure 10:
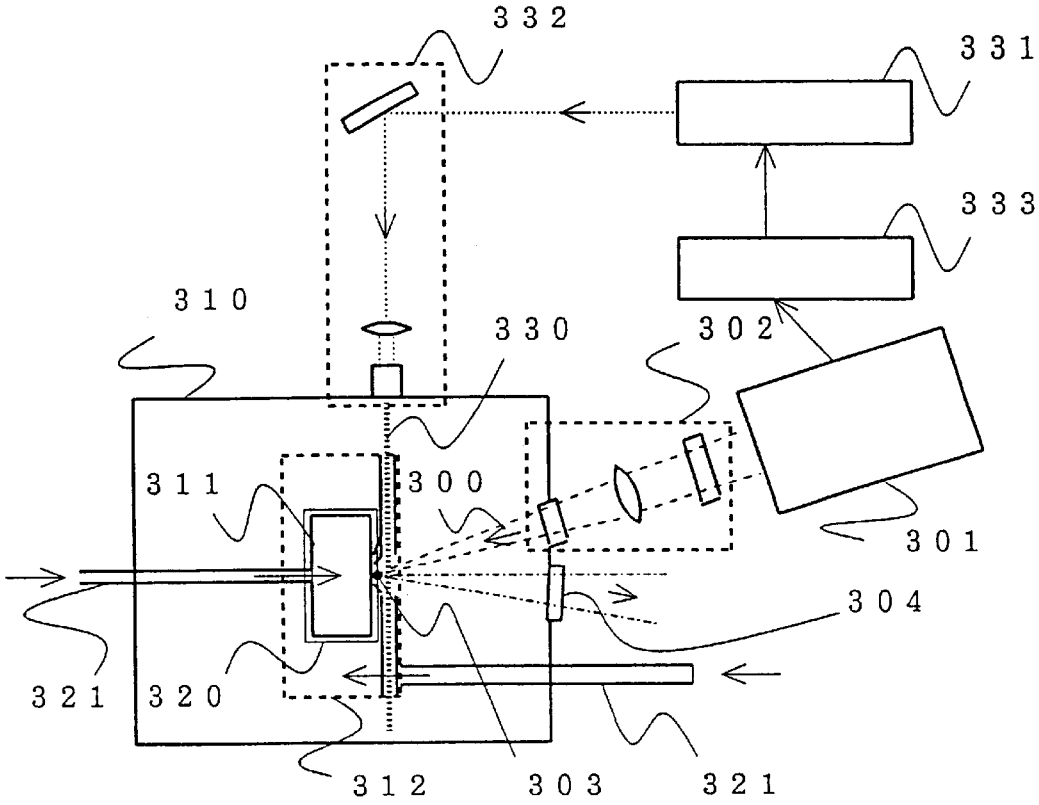
FIG. 10 is a view for describing one embodiment of the blocks and the arrangement of a continuous X-ray generation apparatus according to the present invention but different from FIG. 4.

FIG. 10 is different from FIG. 4 in that a converging irradiation spot 303 on a cryogenic target layer 320 where X-rays are generated by a laser beam 300 is located on a bottom surface of a cylindrical rotary element 311 which is perpendicular to the rotation axis thereof.

The continuous X-ray generation apparatus illustrated in FIG. 10 comprises, as main components, a main laser 301 for generating the pulsed main laser beam 300 for plasma generation, the cylindrical rotary element 311 cooled within a vacuum chamber 310, a supply path 321 for supplying a gaseous cryogenic material to form a cryogenic target layer 320 for generating the X-rays on the bottom surface of the cylindrical rotary element 311, and an auxiliary laser 331 for generating a pulsed auxiliary laser beam 330 to evaporate fine particles ejected from the cryogenic target layer 320.

The main laser 301 comprises, as an optical system 302, a reflecting mirror for guiding the main laser beam 300 and a condensing lens for converging irradiation through an incident glass window to a converging irradiation spot 303 on the surface of the cryogenic target layer 320. The auxiliary laser 331 comprises, as an optical system 332, a reflecting mirror for guiding the auxiliary laser beam 330 and a condensing lens for converging the beam through the incident glass window in the vicinity of an area where the fine particles are ejected. Although not shown in the figure, a swinging unit may be provided as a mechanism for swinging the orientation of the reflecting mirror in order to spatially sweep a converging irradiation region of the auxiliary laser beam 330.

The apparatus further comprises a control unit 333 for controlling the auxiliary laser 331 to emit the auxiliary laser beam 330 with a controlled delay with respect to a synchronization signal received from the main laser 301, and an X-ray emission port 304. A fixed wall 312 may be provided to confine the cryogenic material supplied through the supply path 321 around the rotary element 311.

Next referring to FIG. 11, description will be made of one embodiment of a portion for continuously generating X-rays in FIG. 10.

Figure 11:
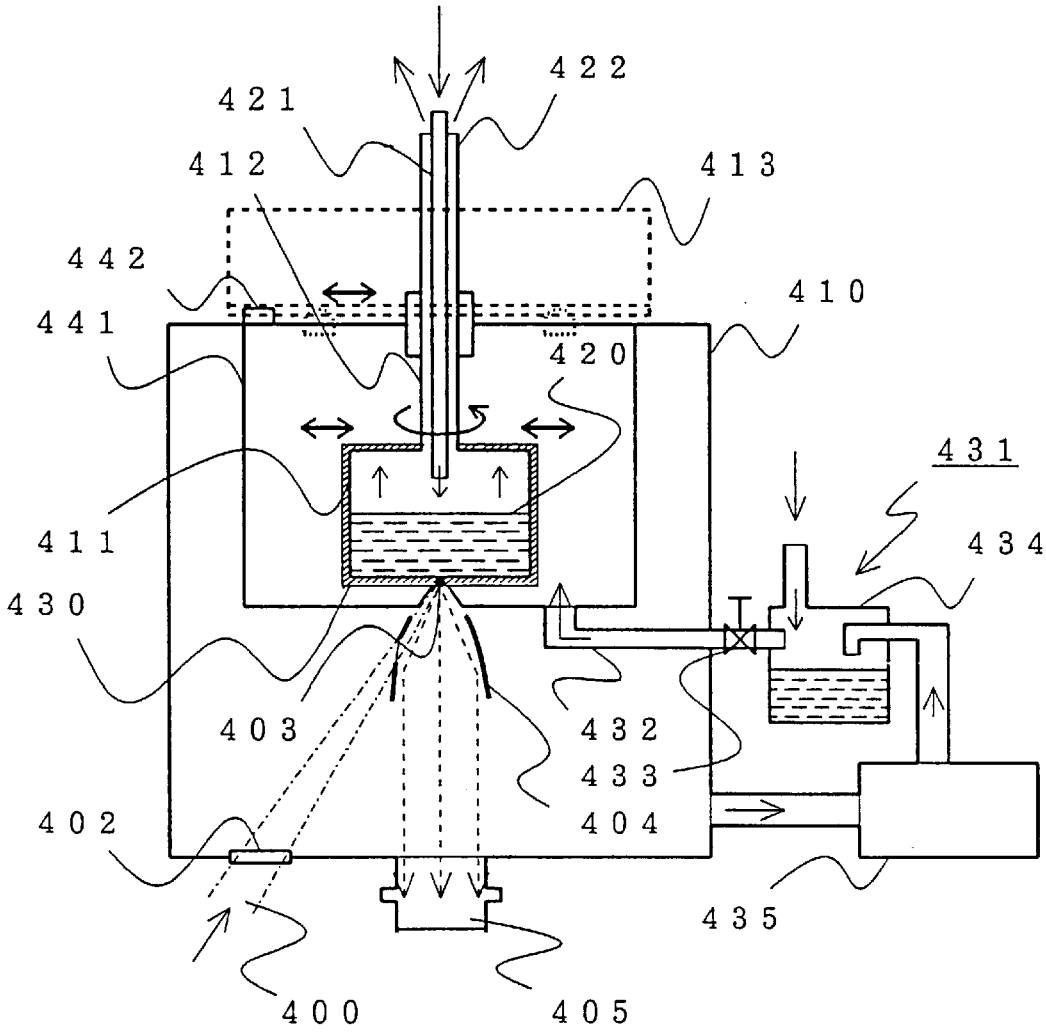
FIG. 11 is a sectional view for describing one embodiment of a portion for continuously generating X-rays in FIG. 10.

Like in FIG. 7, the continuous X-ray generating portion of the continuous X-ray generation apparatus illustrated in FIG. 11 comprises means for generating laser plasma X-rays in response to a main laser beam 400, a vacuum chamber 410, a cylindrical rotary element 411, a rotary shaft 412 of the rotary element 411, a rotation drive mechanism 413 for driving the rotation and the displacement of the rotary element 411, cooling means for cooling the rotary element 411, a target supply mechanism 431 for supplying a cryogenic material to form a cryogenic target layer 430 to the rotary element 411, and a fixed wall 441.

FIG. 11 is different from FIG. 7 in one respect that a converging irradiation spot 403 of the main laser beam 400 is located on the bottom surface of the cylindrical rotary element 411 and an aperture of the fixed wall 441 is provided at the position of the converging irradiation spot 403. Another respect is that the rotation drive mechanism 413 including a mechanism for rotating the rotary element 411, for example, a motor and a drive gear may further include a mechanism for driving the reciprocal movement of the rotary element 411 in the direction perpendicular to the rotation axis. As a result, the converging irradiation spot 403 of the main laser beam 400 can be displaced over a wide range on the bottom surface of the cylindrical rotary element 411. In this case, the rotation drive mechanism 413 is coupled with vacuum chamber 410, for example, using an O-ring seal.

As described above, the cryogenic target layer 430 can be continuously supplied to the converging irradiation spot 403 of the main laser beam 400 by rotating the rotary element 411. Furthermore, by the reciprocal movement of the rotary shaft 412 together with the rotary element 411 in the direction perpendicular to the rotary shaft, the cryogenic target layer 430 freshly formed on the bottom surface of the cylindrical rotary element 411 in the range of the reciprocal movement can be continuously supplied to the converging irradiation spot 403.

Thus, when the rotary element 411 excellent in thermal conductivity is cooled to cryogenic temperature to form the cryogenic target layer 430 on the surface of the cylindrical body, the cryogenic target layer 430 can be formed to an appropriate thickness by selecting the rotation speed of the rotary element 411, the surface temperature of the bottom surface of the cylindrical body, and the feeding rate of the cryogenic material supplied to the bottom surface of the cylindrical body, and so on. Since the position of the converging irradiation spot 403 of the main laser beam 400 can be successively displaced by the rotation of the rotary element 411 and the reciprocal movement in the direction perpendicular to the rotation axis, the rotary element 411 can be prevented from being damaged by the plasma produced at the converging irradiation spot 403.

Except the above-mentioned differences, the components identified by the same name and assigned with the same reference numerals at lower two digits are similar in function to those described in conjunction with FIG. 7. The structure of each component may be modified in correspondence to the above-mentioned differences, although the description thereof is omitted.

Next referring to FIG. 12, description will be made of one embodiment in case where a disc-shaped target member is added to the embodiment of FIG. 11.

Figure 12:
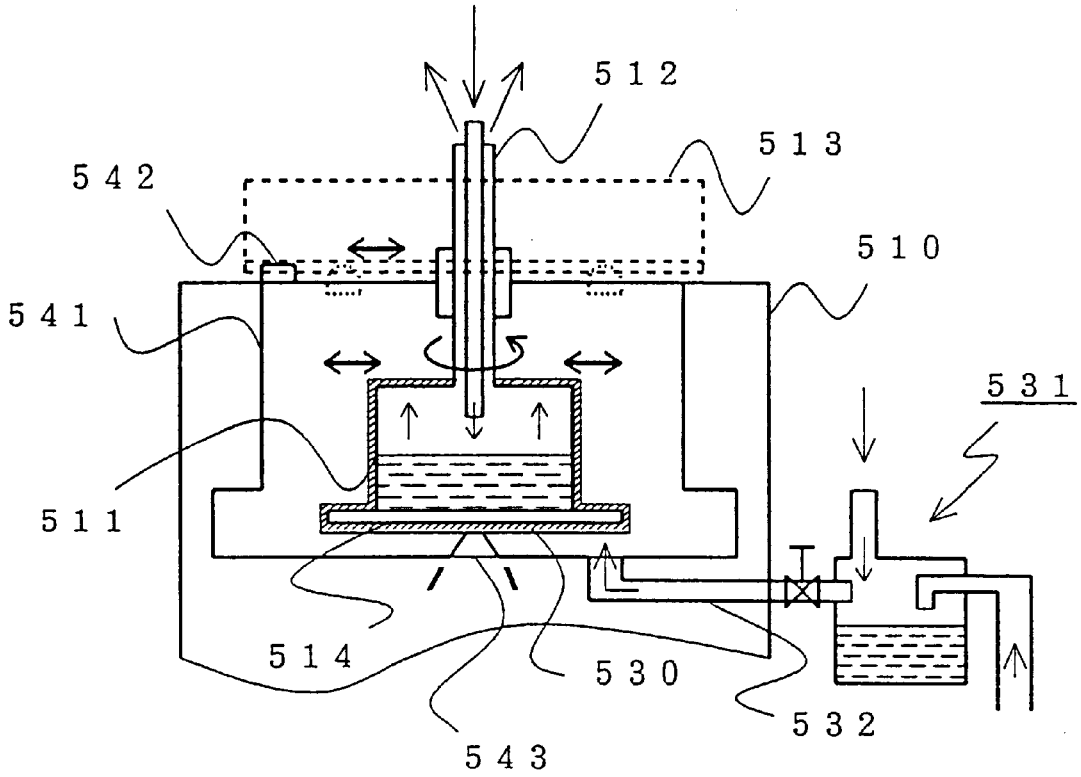
FIG. 12 is a partial sectioned view for describing one embodiment in which a disc-shaped target member is added to the embodiment of FIG. 11.

FIG. 12 is different from FIG. 11 in the following respect. A disc-shaped target member 514 excellent in thermal conductivity is kept in tight contact with the bottom surface of the cylindrical rotary element 511. Utilizing heat conduction of the rotary element 511 having an internal space as a cooling tank and the target member 514, the surface of the target member 514 together with the rotary element 511 are cooled to a temperature not higher than the liquefaction temperature of the cryogenic material forming the cryogenic target layer 530. Therefore, the shapes of related portions such as a fixed wall 541 are different. Except the above-mentioned difference, the components identified by the same name and assigned with the same reference numerals at lower two digits are similar in function to those described in conjunction with FIG. 11 and description thereof is omitted.

The disc-shaped target member is kept in tight contact with the rotary element in the foregoing description but may be integral with the rotary element having a single internal space.

In the foregoing, description has been made with reference to the respective figures under the suitable conditions given. The structure such as the shapes, the sizes, and the mutual positions illustrated and described and a combination thereof may be freely selected as far as the above-mentioned functions are satisfied, although these factors are related to one another as well as the environmental conditions. Thus, this invention is not restricted to the foregoing description.

As described above, according to the present invention, the cylindrical surface of the rotary element excellent in heat conduction efficiency and cooled by the cryogenic fluid or the like serves as a substrate on which the cryogenic target layer is formed. In addition, the supply of the cryogenic material is transferred by the rotation of the rotary element and the reciprocal movement of the converging irradiation spot of the laser beam. Accordingly, the surface of the rotary element is prevented from being damaged and the replacement of the rotary element becomes unnecessary.

Since the surface of the rotary element is directly cooled by the cryogenic fluid, the temperature of the surface of the rotary element as the substrate for the cryogenic target layer can easily be kept at a predetermined temperature. It is therefore possible to stably form and maintain the target layer.

Since the cryogenic material is confined within the fixed wall, the cryogenic material to form the cryogenic target can be very efficiently and uniformly condensed and deposited on the surface of the rotary element. Furthermore, by provision of the aperture having the partition wall, the pulsed laser beam can be repeatedly converged and irradiated at a high frequency while the cryogenic target layer is formed. Accordingly, the pulsed X-rays can be generated semi-permanently and quasi-continuously in response to the pulsed laser beam. Since the cryogenic material gas is prevented by the partition wall from spreading to the vicinity of the converging irradiation spot of the laser beam or into the optical path of the emitted X-rays, it is possible to prevent the effective intensity of the pulsed X-rays from being decreased due to re-absorption of the generated pulsed X-rays by the cryogenic material gas itself.

The fine particle debris emitted from the target after generation of the laser plasma can be vaporized and gasified by heating the debris with the auxiliary laser beam for evaporation which is controlled in timing. Therefore, the multi-layer film of the expensive X-ray reflecting mirror for reflecting the laser plasma X-rays is prevented from being damaged. Since only a very small space is required for evaporation, the X-ray reflecting mirror can be disposed close to the target so that a bright optical system for receiving the plasma X-rays can be created. Thus, the replacement of the X-ray reflecting mirror becomes unnecessary.

As described above, it is possible according to the present invention to provide the continuous laser plasma X-ray generation apparatus which does not require the replacement of the substrate structure for the cryogenic target layer to be formed thereon because of the stable formation and the transfer of the cryogenic target layer, which overcomes the problem of re-absorption of the pulsed X-rays by the cryogenic material gas itself, which is capable of continuously generating the pulsed X-rays having a stable high average output level without requiring the replacement of the X-ray reflecting mirror having the multi-layer film even if the repetitive-shot pulsed laser beam having high peak power is irradiated, which has a simple structure and semi-permanent life and is low in cost and practically usable.

What is claimed is:

1. A continuous X-ray generation method of continuously generating X-rays using a laser, said method comprising the steps of preparing a cryogenic target formed by a chemically inert cryogenic material having a gaseous phase at room temperature;

preparing an apparatus for generating a plurality of laser beams different in intensity from one another; and irradiating the laser beams towards said cryogenic target to continuously generate the X-rays and to remove undesired materials accompanying the generation of the X-rays.

2. A continuous X-ray generation method of continuously generating pulsed X-rays from plasma generated by converging and irradiating a repetitive-shot pulsed main laser beam having high peak power to a target, said method comprising the steps of:

preparing a chemically inert cryogenic material having a gaseous phase at room temperature, a rotary element which has a surface excellent in heat conductivity, which is rotatable in a vacuum chamber, and which serves as a target substrate for the main laser beam, and an auxiliary pulsed laser beam separate from the main laser beam;

supplying a cryogenic fluid to said rotary element to cool at least a part of the surface of said rotary element to a temperature not higher than the liquefaction point of said cryogenic material;

supplying said cryogenic material in a gaseous phase to the surface of said rotary element being cooled to form a cryogenic target layer of a predetermined thickness from said cryogenic material converted into at least one of a liquid phase and a solid phase;

continuously generating pulsed X-rays from plasma produced by converging and irradiating the repetitive-shot pulsed main laser beam having high peak power onto said cryogenic target layer as said target, and;

irradiating the auxiliary laser beam to fine particle debris of said cryogenic target layer which are ejected from the converging irradiation spot after dissipation of the plasma, thereby heating the fine particle debris to vaporize and eliminate the fine particle debris.

3. A continuous X-ray generation method as claimed in claim 2, wherein the amount of supply of said cryogenic material in a gaseous phase is adjusted so that said cryogenic target layer is formed in a predetermined thickness in response to the rotation speed of said rotary element.

4. A continuous X-ray generation apparatus for continuously generating pulsed X-rays from plasma generated by converging and irradiating a repetitive-shot pulsed main laser beam having high peak power onto a target which is made of a chemically inert cryogenic material having a gaseous phase at room temperature, said apparatus comprising:

main laser beam generating means for generating the pulsed main laser beam;

a rotary element having a surface excellent in heat conductivity, rotatable within a vacuum chamber, and used as a target substrate for the main laser beam;

a rotation drive mechanism for driving a rotation shaft of said rotary element to rotate said rotary element;

cooling means for supplying a cryogenic fluid to said rotary element to cool at least a part of the surface of said rotary element to a temperature not higher than the liquefaction point of said cryogenic material;

a cryogenic material supply mechanism for supplying said cryogenic material to the cooled surface of said rotary element to cool said cryogenic material so that a cryogenic target layer having a predetermined thickness is formed from said cryogenic material in at least one of a liquid phase and a solid phase;

main pulse laser irradiating means for converging and irradiating the generated main laser beam onto a predetermined converging irradiation spot of said cryogenic target layer to generate the plasma; and auxiliary laser beam supplying means for generating a pulsed auxiliary laser beam to heat and vaporize or gasify fine particle debris of said cryogenic material that is discharged from the surface of the converging irradiation spot of said cryogenic target layer.

5. A continuous X-ray generation apparatus as claimed in claim 4, further comprising, as a structure for forming said cryogenic material deposited on the surface of said rotary element being rotated into said cryogenic target layer having a substantially uniform thickness, a fixed wall surrounding said rotary element with a predetermined gap adapted to receive and trap said cryogenic material in a gaseous phase supplied from said cryogenic material supply mechanism, and a heat insulating structure cooperating with said cooling means to control and maintain the temperature of said fixed wall at an intermediate level between the liquefaction point of said cryogenic material and room temperature.

6. A continuous X-ray generation apparatus as claimed in claim 4, wherein said fixed wall comprises a partition wall which is formed in the vicinity of the converging irradiation spot in an aperture for incidence of the main laser beam and emission of the X-rays and which defines the thickness of said cryogenic target layer and extends to the surface thereof.

7. A continuous X-ray generation apparatus as claimed in claim 4, wherein said rotary element has a cylindrical shape, said cooling means has, as a cooling tank, an internal space defined by the cylindrical surface of said rotary element, said cooling tank being provided with an inlet pipe and a discharge pipe coaxial with said rotary shaft, said inlet pipe being for introducing, as a cryogenic fluid, low-temperature liquefied gas reserved in the cooling tank for cooling said rotary element, said discharge pipe being for discharging the low-temperature liquefied gas after gasified in said cooling tank.

8. A continuous X-ray generation apparatus as claimed in claim 7, wherein the tip of said inlet pipe within said cooling tank has a nozzle shape for generating a cryogenic gas stream by adiabatic expansion of the discharged low-temperature liquefied gas.

9. A continuous X-ray generation apparatus as claimed in claim 4, wherein said cryogenic material supply mechanism is for supplying at least one kind of cryogenic materials in a gaseous phase onto the surface of said rotary element and comprises a cryogenic material gas supply pipe, a variable flow rate valve for controlling the gas flow rate, and a reservoir tank for reserving the recovered cryogenic material, at least said variable flow rate valve and said reservoir tank being provided for each kind of the cryogenic material.

10. A continuous X-ray generation apparatus as claimed in claim 4, wherein said auxiliary laser beam supplying means comprises auxiliary laser beam generating means for generating the auxiliary laser beam, an auxiliary laser beam optical mechanism for guiding the generated auxiliary laser beam to an optical path bypassing said cryogenic target layer in the vicinity of the converging irradiation spot and converging the auxiliary laser beam to heat and vaporize or gasify fine particle debris of said cryogenic material being ejected, and auxiliary laser control means responsive to main laser beam generation information from said main laser beam generating means for controlling said auxiliary laser beam generating means to adjust the delay of the auxiliary laser beam guided to said optical path with respect to the main laser beam, the pulse duration, and the pulse energy.

11. A continuous X-ray generation apparatus as claimed in claim 4, wherein said rotary element has a cylindrical shape, said converging irradiation spot being located on a side surface of the cylindrical shape, said rotation drive mechanism being for driving the reciprocal movement of said rotary element in a direction coincident with said rotation shaft.

12. A continuous X-ray generation apparatus as claimed in claim 4, wherein said rotary element has a cylindrical shape, said converging irradiation spot being located on a bottom surface of the cylindrical shape.

13. A continuous X-ray generation apparatus as claimed in claim 12, wherein said rotation drive mechanism further drives the reciprocal movement of said rotary element in a direction perpendicular to said drive shaft.

14. A continuous X-ray generation apparatus as claimed in claim 12, further comprising a disc-shaped target excellent in heat conductivity and having said converging irradiation spot located on one surface thereof, said disc shaped target being kept in tight contact with the bottom surface of said cylindrical rotary element.

15. A continuous X-ray generation apparatus for continuously generating pulsed X-rays from plasma generated by converging and irradiating a repetitive-shot pulsed main laser beam having high peak power onto a target which is made of a chemically inert cryogenic material having a gaseous phase at room temperature, said apparatus comprising:

main laser beam generating means for generating the pulsed main laser beam;

a rotary element having a surface excellent in heat conductivity, rotatable within a vacuum chamber, and used as a target substrate for the main laser beam;

a rotation drive mechanism for driving a rotation shaft of said rotary element to rotate said rotary element and driving the reciprocal movement of a converging irradiation spot of said main laser beam on the surface of said rotary element;

cooling means for supplying a cryogenic fluid to said rotary element to cool at least a part of the surface of said rotary element to a temperature not higher than the liquefaction point of said cryogenic material;

a cryogenic material supply mechanism for supplying said cryogenic material to the cooled surface of said rotary element to cool said cryogenic material so that a cryogenic target layer having a predetermined thickness is formed from said cryogenic material in at least one of a liquid phase and a solid phase; and main pulse laser irradiating means for converging and irradiating the generated main laser beam onto a predetermined converging irradiation spot of said cryogenic target layer to generate the plasma.

* * * * *